US010773885B2

(12) United States Patent
Dall'Armi

(10) Patent No.: US 10,773,885 B2
(45) Date of Patent: Sep. 15, 2020

(54) DYNAMIC MOVABLE INTEGRATED SYSTEM FOR WASTE COLLECTION

(71) Applicant: Pietro Dall'Armi, Vicenza (IT)

(72) Inventor: Pietro Dall'Armi, Vicenza (IT)

( * ) Notice: Subject to any disclaimer, the term of this patent is extended or adjusted under 35 U.S.C. 154(b) by 298 days.

(21) Appl. No.: 15/553,383

(22) PCT Filed: Feb. 18, 2016

(86) PCT No.: PCT/IB2016/050870
§ 371 (c)(1),
(2) Date: Aug. 24, 2017

(87) PCT Pub. No.: WO2016/135592
PCT Pub. Date: Sep. 1, 2016

(65) Prior Publication Data

US 2018/0072496 A1 Mar. 15, 2018

(30) Foreign Application Priority Data

Feb. 26, 2015 (IT) ..... RM2015A0088

(51) Int. Cl.
*B65F 1/00* (2006.01)
*B65F 1/14* (2006.01)
*B30B 9/30* (2006.01)

(52) U.S. Cl.
CPC ..... *B65F 1/0046* (2013.01); *B30B 9/3092* (2013.01); *B65F 1/1447* (2013.01);
(Continued)

(58) Field of Classification Search
CPC .... B30B 9/3092; B65F 1/1405; B65F 1/1426; B65F 1/0046; B65F 1/1447; B65F 2210/128; B65F 2210/168; B65F 2210/1443; B65F 2210/162; B65F 2210/138
(Continued)

(56) References Cited

U.S. PATENT DOCUMENTS 3,447,449 A * 6/1969 Kostolich ..... B30B 9/3089 100/95
3,858,504 A * 1/1975 Boyer ..... B09B 3/0025 100/74
(Continued)

FOREIGN PATENT DOCUMENTS

EP 0 618 154 A1 10/1994
EP 1 205 404 A1 5/2002
(Continued)

OTHER PUBLICATIONS

International Search Report, dated Feb. 18, 2016, from corresponding PCT application No. PCT/IB2016/050870.

*Primary Examiner* — Jimmy T Nguyen
(74) *Attorney, Agent, or Firm* — Nixon & Vanderhye

(57) ABSTRACT

Movable integrated system for waste collection, including a container structure, adapted to be installed at least partially above ground, the structure including a plurality of access doors to a plurality of waste collection compartments or containers contained in the container structure that are made of two-dimensional modular structure; the container structure integrates a waste compaction unit supplied by a respective access hatch and transferring compacted waste into the collection containers.

15 Claims, 3 Drawing Sheets

(52) U.S. Cl.
CPC ... *B65F 2210/128* (2013.01); *B65F 2210/138* (2013.01); *B65F 2210/1443* (2013.01); *B65F 2210/162* (2013.01); *B65F 2210/168* (2013.01)

(58) Field of Classification Search
USPC ..... 100/221, 224, 225, 226
See application file for complete search history.

(56) References Cited

U.S. PATENT DOCUMENTS

| | | | | |
|---|---|---|---|---|
| 4,996,918 | A * | 3/1991 | Carter | B02C 18/0084 100/221 |
| 5,638,747 | A * | 6/1997 | Peng | B30B 9/3092 100/102 |
| 2010/0071572 | A1* | 3/2010 | Carroll | B30B 9/3007 100/229 A |

FOREIGN PATENT DOCUMENTS

| | | | |
|---|---|---|---|
| EP | 2 662 317 | A1 | 11/2013 |
| FR | 2 710 329 | A1 | 3/1995 |
| WO | 2005/002994 | A1 | 1/2005 |
| WO | 2009/106522 | A1 | 9/2009 |

* cited by examiner

DYNAMIC MOVABLE INTEGRATED SYSTEM FOR WASTE COLLECTION

FIELD OF THE APPLICATION

The present invention regards the field of waste. In detail, the present invention regards a movable integrated system for waste collection.

PRIOR ART

Today, waste collection occurs through three methods, due to the use of compactor road vehicles and containers or better yet receptacles, bell-shaped vessels, bins or other items which are specific for waste collection, with the aid of specialized operators for the manual operations of collection, movement and transport of the waste from streets, apartment buildings or collection-assigned areas; the equipment mounted in the chassis is formed by container gripping systems, which are driven by the operator and which unload the waste in a tank of the cradle or casing, through a system which compacts the waste.

The current systems have a low compaction percentage and are inefficient for some types of waste, such as organic, plastic and EPS, among others.

The waste collection systems of known type are substantially conventional street collection or door-to-door collection.

Conventional street collection does not involve set times/types during the waste insertion period, but it has various problems; first of all, it is poorly differentiated and often causes city traffic, and then there is the problem of waste traceability, and of the quantities inserted therein. Substantially, the load of the waste is poorly traced and not well optimized.

Door-to-door collection works well with regard to differentiation, but involves set-time/type insertions, since the user must comply with collection calendars, timetables, set days and waste type; it is slower and costlier, and also creates difficulties in managing the traceability and the quantity inserted by each user.

Finally, there is a third mode of collection that uses large buried containers termed "separate ecological collection sites", in which the waste is thus grouped in a specific area of the urban environment. Through the "separate ecological collection sites", it is possible to identify users by macro-area, and they allow identifying waste types.

The installation and maintenance are very costly, given that the use of powerful actuators—commanded by hydraulic control stations—if present, involve the installation of fixed building works.

Alternatively, the separate ecological collection sites are merely of collection type, without actuators for the compaction of the waste.

The buried separate ecological collection sites require cranes for lifting the waste containers included therein, which causes a considerable increase of costs as well as complex maneuvers.

However, the conventional collection systems do not prevent the so-called "empty run": with such term, it is intended a collection run carried out by a vehicle in which the operator does not find material for the waste collection.

It is also inferred that there is no uniformity among the various mechanical gripping systems in the separate ecological collection site containers, since these are not based on a single standard in use. For example, there are containers of DIN 1100/1700 type or with double-comb connection.

The use of large trucks for unloading the containers becomes difficult, especially on narrow streets, and is therefore inefficient.

In addition, the burying of the separate ecological collection site always causes a considerable installation cost.

The object of the present invention is to describe a movable integrated system for waste collection which lacks the above-described drawbacks.

SUMMARY OF THE INVENTION

According to the present invention, a movable integrated system for waste collection is attained which comprises a container structure, adapted to be installed above ground, comprising a plurality of access doors to a plurality of waste collection containers contained in said container structure; said container structure integrates waste compaction means supplied by a respective access hatch and transferring compacted waste into said collection containers positioned in a lower portion with respect to said waste compaction means, and wherein said lower portion is configured to be installable in a trench in the ground in a position hidden from view and is also configured for being extracted by mechanized gripping means of an extraction machine of crane type.

The waste collection containers, or compartments, are made of two-dimensional modular structure, in the sense that they are extended over a single plane along two orthogonal directions, during use parallel to the ground.

Advantageously, a number of said compaction means are present and installed, equal to at least one for each collection container.

Advantageously, said compaction means comprise a bulkhead movable with free movement, installed on a plurality of pads which are positioned at the corners and which slide on respective tracks; said movable bulkhead defines two compartments for each collection section or container.

Advantageously, two thrust bulkheads are also present, connected to the walls of the section by an air lifting cushion that moves them forward and backward along a linear path; the two thrust bulkheads are oriented along a plane parallel to the plane on which said movable bulkhead lies.

Advantageously, in addition, a first seal ring with rectangular shape is present, fixed to the fixed bulkheads in the collection compartments or containers; said first seal ring is positioned at a predefined distance between the fixed bulkhead and the thrust bulkhead and the free movable bulkhead that deliberately delimits the movements of the same bulkheads in the compartments, thus creating an area of minimum unloading and an area of maximum loading on the other side of the ring; said system also comprising a second seal ring for each collection container or compartment; said second seal ring is positioned on the opposite side of the free movable bulkhead.

Advantageously, for each collection container, fill sensor means are present; said sensor means are electronically interfaced with a programmable logic controller, and are configured for transmitting thereto, in real time, the fill data of each of the collection containers or compartments.

Advantageously, a user totem is also present which is electrically connected with a data processing unit; said user totem is configured for transmitting, through user interface means of at least visual type, information, indications and commands for waste insertion into the various collection containers; said user totem being configured for supervising the opening of access doors to the various containers.

Advantageously, said system also comprises means defining a geographical position of said container and a software program configured for receiving and/or storing the geographical position of one or more containers and automatically transmitting data of departure of waste collection vehicles for the emptying of said container; said departure data is transmitted in accordance with an electronic calculation of said geographic positions of said one or more containers in relation to a position of departure of said waste collection vehicles.

Advantageously, said departure data is also transmitted in accordance with fill data of one or more containers automatically transmitted by fill sensor means installed in each one of the collection containers.

Advantageously, said means defining said geographical position are global positioning means installed on said container and configured for automatically transmitting said position to a predefined remote electronic processor.

Advantageously, for each collection container, at least one from among the following waste volume reduction means is present: round baler, shredder, screw or roller compactors, driers, briquetting machines or automatic selectors.

DESCRIPTION OF THE FIGURES

The invention will be described hereinbelow in a preferred and non-limiting embodiment thereof, with the aid of the enclosed figures, in which.

DETAILED DESCRIPTION OF THE INVENTION

Figure 1:
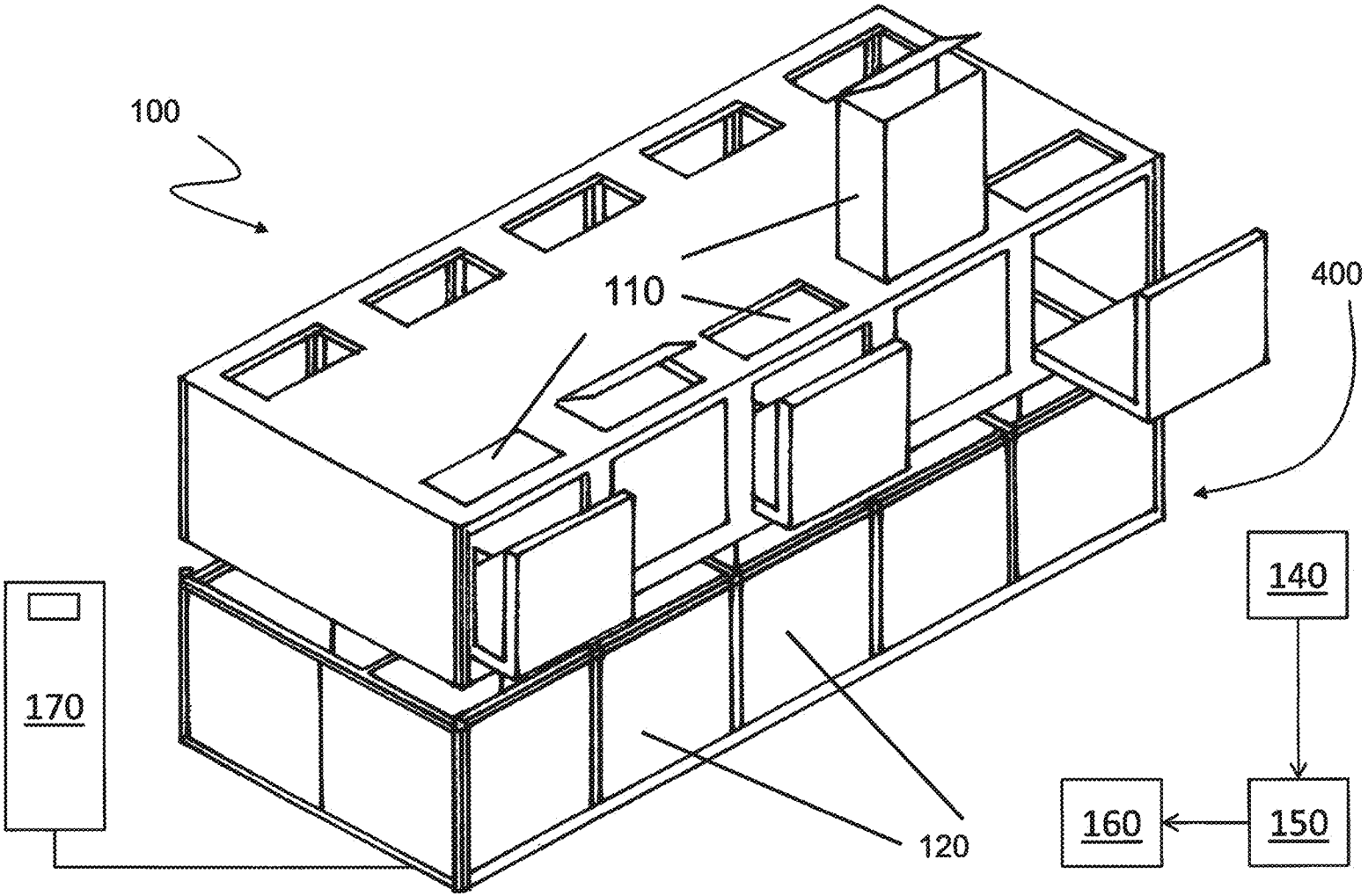
FIG. 1 illustrates a first perspective view of the waste collection system, object of the present invention.
Figure 2:
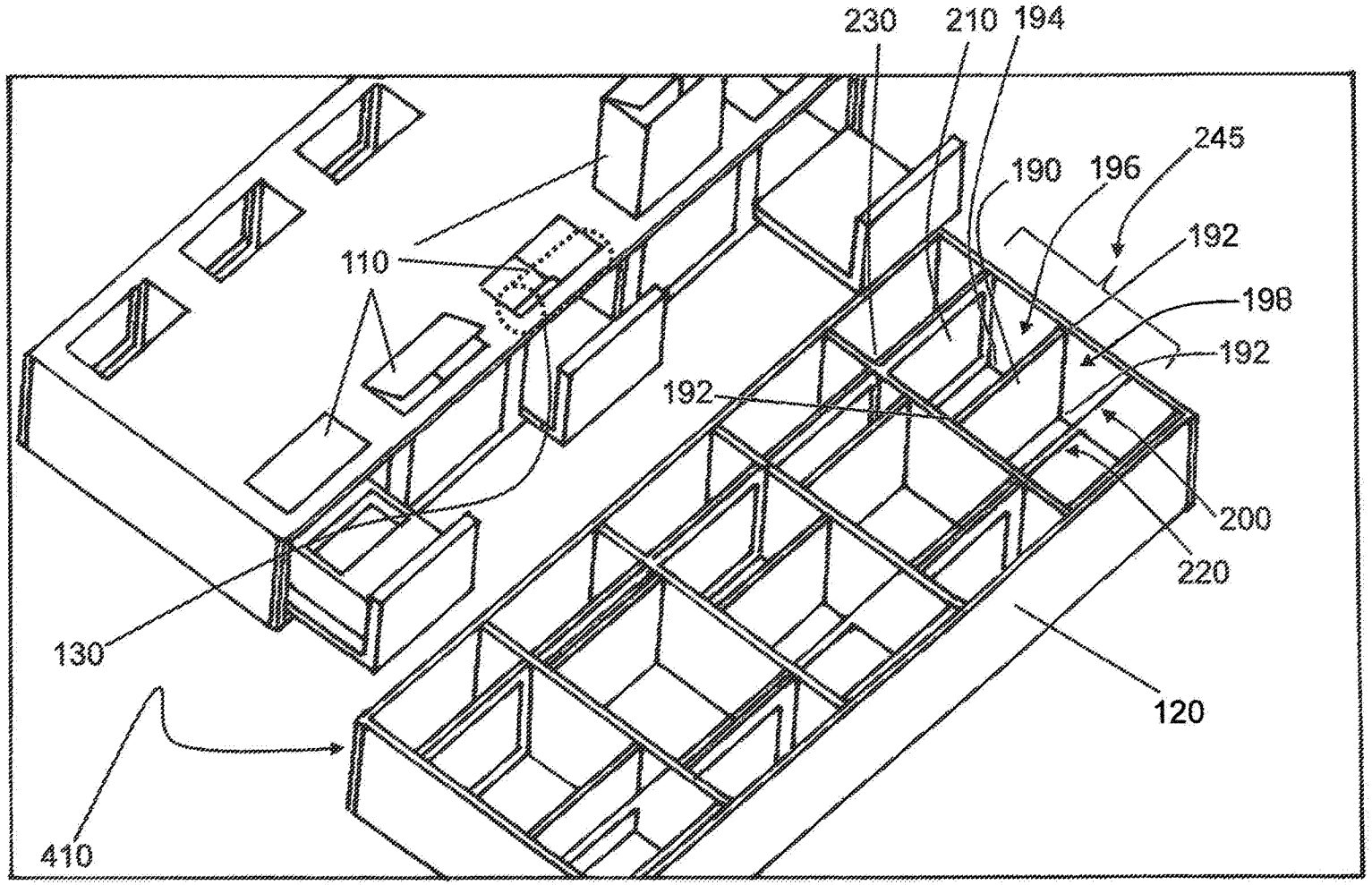
FIG. 2 illustrates a second perspective view of the system of FIG. 1.
Figure 3:
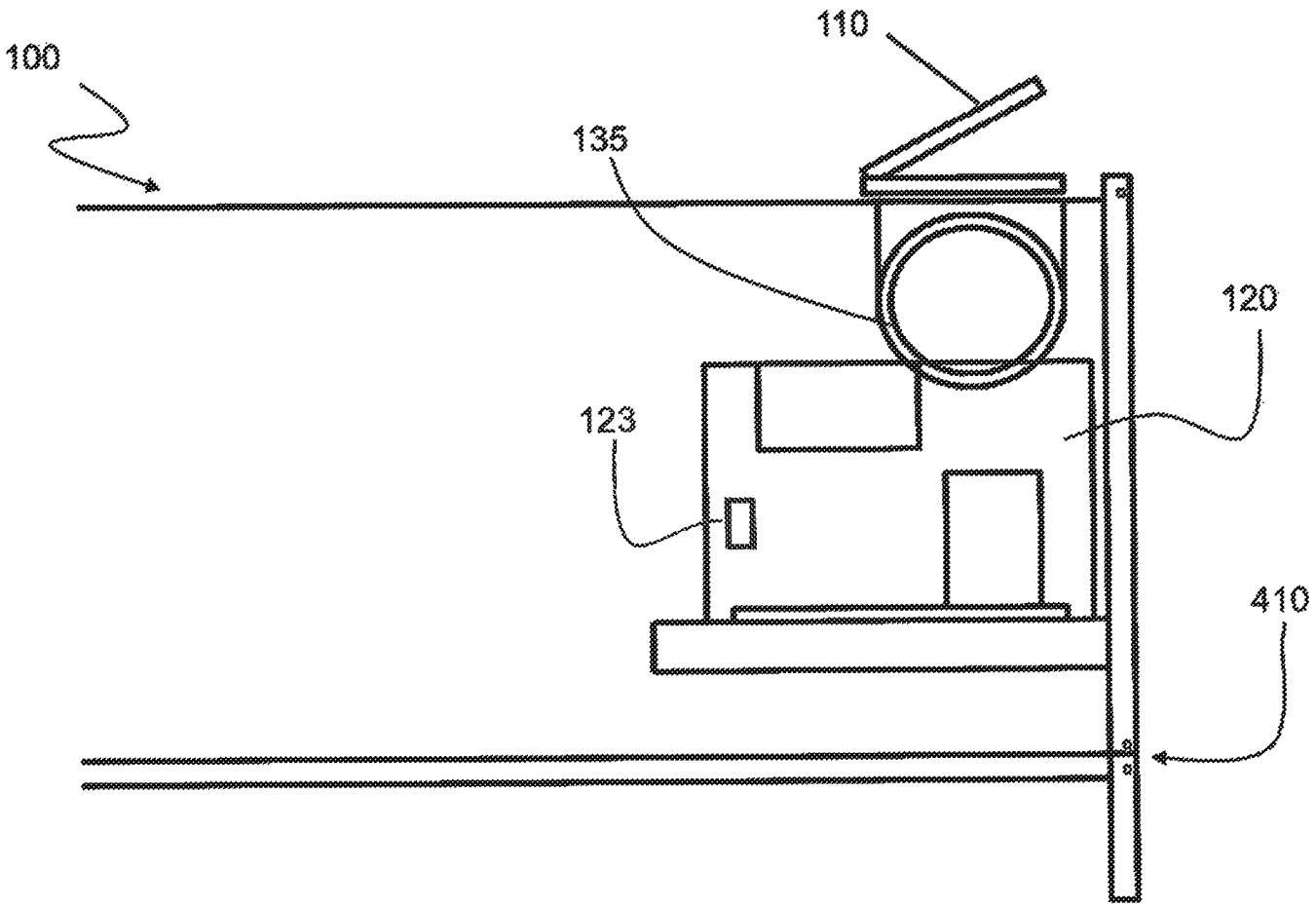
FIG. 3 illustrates a section view of part of the system of FIG. 1.

With reference to the enclosed figures, reference number 100 overall indicates a movable integrated system for waste collection.

The system 100 comprises a container structure adapted to be installed above ground, which comprises a plurality of access doors 110 to a plurality of collection containers 120 contained in the structure itself, in a manner such that each access door accesses a specific collection container.

In detail, the access doors 110 are opened onto an area reserved for the compaction of waste, where compaction means 130 provide for compacting waste, before transferring such waste into the respective collection container 120.

The compaction means 130 are installed in modules that can be independently extracted with respect to each other. This advantageously allows being able to easily substitute the compaction means 130 in case of failure, or a complete substitution thereof with increasingly innovative solutions, in accordance with the type of waste to be compacted.

The access doors 110 are preferably positioned at the roof of the container structure, so as to facilitate the deposition of the waste.

Advantageously, each compaction means 130 is separated from the access doors 110 by means of the safety bushes 135, which prevent the compaction of the waste if the access doors 110 are open.

Within the safety bushes 135, different sensors are present: preferably, in a non-limiting manner, said sensors alternatively or in combination comprise at least one of the following categories of sensors:

- sensors for verifying the fill of the bush, which advantageously allow indicating possible obstructions thereof before the transfer of the waste into the lower portion for the compaction;
- photographic sensors, which advantageously allow visually identifying the type of waste, in real time and from a remote position, so as to be able to advantageously interrupt the compaction of the waste if the type thereof is different from that previously defined with regard to the specific safety bush;
- load sensors, which advantageously allow determining, from upstream of the compaction, the quantity of waste collected each time for each bush 135.

The sensors present in the safety bushes 135 therefore allow proceeding with a tracing of the waste, in order to then make an association with a specific user.

The collection containers 120 are therefore divided by fixed bulkheads, within which the extractable monobloc modules are situated, each one provided with a compaction means 130.

The system 100, object of the present invention, also comprises light and acoustic signaling systems for the user indications and the various service operator indications, relative as a non-limiting example to the compaction means 130.

A programmable logic controller 140, or equivalent data processing unit, controls all the servosystems for driving the system actuators, for example:

- an electric power line;
- an electric auxiliary line, powered by a battery pack, so as to allow the operation of the system even without electrical power supply;
- a compressed air supply line for the auxiliary subsystems.

Such programmable logic controller is interfaced with a data processing unit 150 which allows modifying the data received from the programmable logic controller at a higher level, transmitting at least part of such data—through a modem 160—to remote electronic processors for a post-processing which comprises, as a non-limiting example, an extraction of statistics data of use, compaction or fill of one or more containers 120 or of an alarm.

The system 100 also comprises a user totem 170, electrically connected with the data processing unit 150, which allows the waste-inserting user to have access to information, indications and commands for the operations. In particular, through the user totem 170, it is possible to open the access hatches to the various containers.

On the lower part 400, the system 100, object of the present invention, comprises a structure 245 divided into sections by fixed bulkheads, positioned in an equivalent manner with respect to the fixed bulkheads of the upper part, hence forming a single section shared between the upper portion and the lower portion.

The sections are divided in half by a bulkhead 190 movable with free movement, installed on a plurality of pads 192—preferably four, in a non-limiting manner—which are positioned at the comers and which slide on respective tracks 194. The movable bulkhead 190 therefore defines two compartments 196, 198 for each section.

Parallel to the movable bulkhead 190, two thrust bulkheads 200, 210 are present, connected to the walls of the section by an air lifting cushion that moves them forward and backward along a linear path.

A seal ring 220 with rectangular shape and fixed to the fixed bulkheads in the compartments is positioned at a predefined distance between the fixed bulkhead and the thrust bulkhead and the free movable bulkhead 190 that deliberately delimits the movements of the same bulkheads in the compartments, thus creating an area of minimum unloading and an area of maximum loading on the other side of the ring. A further seal ring 230 is positioned on the opposite side of the free movable bulkhead 190, hence creating two identical zones.

The waste is therefore compacted in a chamber defined by the bottom of the container, by the two fixed walls and by the two seal rings.

The movement of the thrust bulkheads towards the seal ring creates a new free space for the unloading of the compacted waste from the extractable/compacting monobloc/modules positioned above.

The upper portion of the container is the operating portion, where all the steps of processing, receiving and analysis and control of the waste take place.

The lower part 400, which is held together with the upper portion through automatic or semiautomatic mechanical junction means 410, receives the waste already compacted and differentiated, when unloaded from the upper portion. From the lower part, the waste can be picked up via vehicles of tractor type, even simple vehicles or those with special collection equipment.

During use, when the lower part 400 is full, such filling is electronically signaled by the system 100 to a remote station. The entire system is therefore substituted with a new one.

In addition, the transport of the lower part 400 to the final destination—where all the waste picked up from the various systems 100 distributed throughout the city is collected—occurs by means of a second step of transfer with a tired vehicle.

In particular, the containers of the lower portion can be picked up separately, one at a time, in a manner so to be able to obtain a collection that is significantly faster and cleaner than what occurred in the past.

Indeed, in particular, it is only the lower portion 400 of the system 100 that, during use, is emptied, and hence picked up and substituted with a new and empty portion in a single step, advantageously saving time and useful weight to be transported. Indeed the lower part 400 is significantly lighter than the upper part (also because it lacks compaction systems). Indirectly, the vehicle assigned for the transport thereof can therefore save fuel with respect to a solution in which the entire assembly—hence including the actuators and compactors—must be transported.

For each collection container 120, at least fill sensor means 123 are present. Said sensor means are electronically interfaced with the programmable logic controller, and allow obtaining, in real time, fill data and data for programming the trips of the wheeled collection vehicles for the emptying of the containers.

An electronic processor is present in a remote position with respect to the container structure; such processor takes under consideration the position of one or more collection containers, object of the present invention. The position of the container can be manually defined by an operator or alternatively acquired by the various container structures by means of satellite positioning means positioned on said container.

In the electronic processor, a software program is executed which, based on the positions of the containers, calculates the moments provided for the emptying of the collection containers 120 by means of a data processing procedure comprising historical fill data coming from the sensor means and from the current fill, as well as from the mutual distance of the various containers; such procedure therefore represents a centralized digital collection of fill data for the optimization of the emptying of the containers.

For example, if two containers A and B exist with two sections and four chambers, in turn composed of collectors for paper and cardboard, nylon, EPS with 1:1 correspondence (50% of volume for each chamber within the section thereof) between type and chamber.

For example: A is the collector in Via Mario Rossi in Rome and B is the collector in Via Andrea Bianchi in Rome.

The electronic processor measures at a predetermined instant of the day that the collector A has reached 85% of the overall load while B has reached 10% of the overall load.

Through the electronic processor, it is for example possible to transmit data to the totem of the collector A in a manner such to divert the user to the collector B, hence through a process of fill optimization of collaborative type.

Through the electronic processor, it is also possible for example to transmit a waste collection request to one or more trucks assigned for emptying the collection containers 120.

Still through the electronic processor, it is also possible to know users close to the containers, or pioneer users who follow the suggestions for the insertion of waste in nearby containers based on the indications of the totem, or to delineate collection "milestones", overall or per user.

Still through the electronic processor, it is also possible to transmit billing data of the waste collection to public bodies in a precise and quick manner, indeed because through the sensors on the collection containers 120, the system's actual use data is very precise.

Upon installation, the system 100, object of the present invention, only requires a predefined position defined by the public body and an electric current power supply.

With the first power supply, the collection container, or collector, through its data processing unit is configured for automatically transmitting its position to the remote electronic processor, along with its status, and is ready to receive remote commands or waste to be compacted and collected in the collection containers.

When the user approaches the container, he/she first positions electronic recognition means on the totem. On a monitor of the totem, messages appear that request the insertion of the waste in the specific container.

After insertion of the waste, there is the actual step of compaction, as mentioned above starting with the closure of the access door 110.

As an alternative to that stated above, other compaction means can be, as a non-limiting example:

- round balers for pressing discard materials of industrial processing, cardboard, film and fabric, plastic bottles, wood and plastic crates (fruit crates), obtaining a reduction of the volume at the start of 70-75%, even on expandable materials like foam rubber;
- shredders for undifferentiated waste, or brush and plants/vegetation;
- roller compactors, which are able to crush and divide waste after having grasped it;
- dissipaters or driers, capable of treating cooking leftovers by means of dehydration, so as to reduce the volume thereof up to 90%;
- diaper treatment systems, which allow reducing diaper volume up to 70% due to placement under vacuum and to disinfection, hence also contributing to greater overall hygiene of the system 100;
- briquetting machines, i.e. compactors with extruders;
- screw comparators for waste of EPS type;

automatic selectors for bottles, also capable of allowing the user to recover empty, already cleaned bottles through barcode means for reading the bottle type.

The advantages of the system 100, object of the present invention, are clear in light of the preceding description. It allows optimizing the management of the waste collection in an intelligent manner without requiring large building works for burial, contributing to a greater differentiation of the waste and improving the urban environment.

In addition, through the sensor means on the collection containers 120, it is possible to collect data on the quality of the waste, also indicating waste that is not suitable for being deposited in the collection containers.

Through the compaction of the waste, the space necessary for the installation of the system is reduced, and is equal to that of the same systems of known type for waste collection that lack compaction means.

Consequently, the use of the system 100, object of the present invention, has proven economically advantageous over the mid/long-term period. The expenses for purchasing waste compaction and transport vehicles are lowered, indeed because such vehicles may completely lack compaction means.

Such vehicles could travel in a more intelligent and rational manner, no longer delimited by a manual or daily schedule, but based on an actual need that is electronically and automatically controlled in a centralized manner and substantially in real time. Therefore the number of the so-called "empty runs" would be significantly reduced.

In addition, through the system, object of the present invention, it is also possible to optimize the billing of the waste collection for each single user, due in fact to the electronic interface offered by the totem 170.

Since the containers of the lower portion 400 can be emptied one at a time and therefore separately picked up, it is advantageously possible to obtain a significantly faster and cleaner collection with respect to what occurred in the past.

Finally, it is clear that additions, modifications and variations of the system, object of the present invention, can be made which are obvious for the man skilled in the art, without departing from the protective scope provided in the enclosed claims.

The invention claimed is:

1. A movable integrated system for waste collection (100), comprising:

a container structure, configured to be installed at least partially above ground, said container structure comprised of a plurality of waste collection containers (120) in said container structure having a two-dimensional modular structure, and a plurality of access doors each associated with a corresponding one of said waste collection containers, and a plurality of waste compaction means (130), each of the compaction means positioned to receive waste to be compacted from a respective access door (110) of the plurality of access doors, and configured to transfer compacted waste into an associated waste collection container of the plurality of waste collection containers, said waste collection containers positioned in a lower portion (400) of said container structure with respect to said waste compaction means (130), wherein said lower portion (400) is configured to be installable at least partially beneath ground in a position hidden from view, and is also configured for being extracted therefrom.

2. A movable integrated system for waste collection (100), comprising:

a container structure, configured to be installed at least partially above ground, said container structure comprised of a plurality of waste collection containers (120) in said container structure having a two-dimensional modular structure, and a plurality of access doors each associated with a corresponding one of said waste collection containers, and a plurality of waste compaction means (130), each of the compaction means positioned to receive waste to be compacted from a respective access door (110) of the plurality of access doors, and configured to transfer compacted waste into an associated waste collection container of the plurality of waste collection containers, said waste collection containers positioned in a lower portion (400) of said container structure with respect to said waste compaction means (130), wherein said lower portion (400) is configured to be installable at least partially beneath ground in a position hidden from view, and is also configured for being extracted therefrom, and wherein said compaction means comprise a movable bulkhead (190) that is movable with free movement, installed on a plurality of pads which are positioned at the corners of said movable bulkhead and which slide on respective tracks, said movable bulkhead (190) delimiting two compartments for each waste collection container.

3. The system according to claim 2, wherein said compaction means further comprise two thrust bulkheads (200, 210), connected to walls of the waste collection container and movable forward and backward along a linear path, the two thrust bulkheads (200, 210) oriented along a plane parallel to a plane on which said movable bulkhead (190) lies.

4. The system according to claim 3, further comprising:

a first seal ring (220) with rectangular shape, said first seal ring (220) positioned at a predefined distance between a fixed bulkhead and the thrust bulkhead and the free movable bulkhead (190) that delimits movements of the bulkheads in the compartments so as thereby to create an area of minimum unloading at a first side of the first seal ring and an area of maximum loading at an opposite second side of the first seal ring; and a second seal ring (230) in each waste collection container, said second seal ring (230) positioned at a side of the movable bulkhead opposite that of the first seal ring (220).

5. The system according to claim 1, wherein for each waste collection container (120), fill sensor means are present; said sensor means are electronically interfaced with a programmable logic controller, and are configured for transmitting thereto, in real time, fill data of each of the waste collection containers (120).

6. The system according to claim 1, further comprising:

a user totem (170), electrically connected with a data processing unit (150), said user totem configured for transmitting, through user interface means of at least visual type, information, indications and commands for waste insertion in the waste collection containers (120), said user totem (170) being configured for supervising the opening of the access doors to the waste collection containers.

7. The system according to claim 1, further comprising: means defining a geographical position of said waste collection container and a software program configured for receiving and/or storing the geographical position of one or more waste collection containers and automatically transmitting data of departure of waste collection vehicles for the emptying of said waste collection containers, said departure data transmitted in accordance with an electronic calculation of said geographical positions of said one or more waste collection containers in relation to a position of departure of said waste collection vehicles.

8. The system according to claim 7, wherein said departure data is also transmitted in accordance with fill data of one or more waste collection containers, automatically transmitted by fill sensor means installed in each one of the waste collection containers (120).

9. The system according to claim 7, wherein said means defining said geographical position are global positioning means installed on said waste collection container and configured for automatically transmitting said position to a predefined remote electronic processor.

10. The system according to claim 2, wherein for each waste collection container (120), fill sensor means are present; said sensor means are electronically interfaced with a programmable logic controller, and are configured for transmitting thereto, in real time, fill data of each of the waste collection containers (120).

11. The system according to claim 3, wherein for each waste collection container (120), fill sensor means are present; said sensor means are electronically interfaced with a programmable logic controller, and are configured for transmitting thereto, in real time, fill data of each of the waste collection containers (120).

12. The system according to claim 4, wherein for each waste collection container (120), fill sensor means are present; said sensor means are electronically interfaced with a programmable logic controller, and are configured for transmitting thereto, in real time, fill data of each of the waste collection containers (120).

13. The system according to claim 2, further comprising: a user totem (170), electrically connected with a data processing unit (150), said user totem configured for transmitting, through user interface means of at least visual type, information, indications and commands for waste insertion in the waste collection containers (120), said user totem (170) being configured for supervising the opening of the access doors to the waste collection containers.

14. The system according to claim 3, further comprising: a user totem (170), electrically connected with a data processing unit (150), said user totem configured for transmitting, through user interface means of at least visual type, information, indications and commands for waste insertion in the waste collection containers (120), said user totem (170) being configured for supervising the opening of the access doors to the waste collection containers.

15. The system according to claim 4, further comprising: a user totem (170), electrically connected with a data processing unit (150), said user totem configured for transmitting, through user interface means of at least visual type, information, indications and commands for waste insertion in the waste collection containers (120), said user totem (170) being configured for supervising the opening of the access doors to the waste collection containers.

* * * * *